United States Patent [19]

Benasutti et al.

[11] 4,161,767

[45] Jul. 17, 1979

[54] TASK LIGHTING SYSTEM WITH ANGULARLY-DISPLACED FLUORESCENT TUBES

[75] Inventors: Roger Benasutti, St. Paul; Thomas A. Koenig, Stillwater, both of Minn.

[73] Assignee: Conwed Corporation, St. Paul, Minn.

[21] Appl. No.: 838,764

[22] Filed: Oct. 3, 1977

[51] Int. Cl.[2] ..... A61G 13/00

[52] U.S. Cl. ..... 362/33; 362/98; 362/225; 362/234

[58] Field of Search ..... 362/33, 97, 98, 219, 362/225, 234

[56] References Cited

U.S. PATENT DOCUMENTS

| | | | |
|---|---|---|---|
| 1,514,069 | 11/1924 | Rothe | 362/33 X |
| 1,930,085 | 10/1933 | Fehse | 362/225 |
| 2,422,857 | 6/1947 | Schockett | 362/225 |
| 2,589,744 | 3/1952 | Sterling | 362/225 |
| 2,629,814 | 2/1953 | Brown | 362/225 X |
| 3,375,362 | 3/1968 | Klippert | 362/33 |
| 3,802,102 | 4/1974 | Licciardi | 362/97 X |
| 3,805,051 | 4/1974 | Rambauske | 362/225 X |
| 4,071,883 | 1/1978 | Dennis | 362/97 |

OTHER PUBLICATIONS

Shellko et al., *Integration of Task & Ambient Lighting in Office Furniture,* Lighting and Design Application, Sep. 1976, pp. 14–23.

*Primary Examiner*—Peter A. Nelson

*Attorney, Agent, or Firm*—Eyre, Mann, Lucas & Just

[57] ABSTRACT

A task lighting system for home, office or industry utilizes pairs of U-shaped fluorescent tubes at diagonal angles in a shielding enclosure supported a predetermined distance above a work surface. The task lighting system may be integrated into furniture.

3 Claims, 5 Drawing Figures

TASK LIGHTING SYSTEM WITH ANGULARLY-DISPLACED FLUORESCENT TUBES

BACKGROUND OF THE INVENTION

The lighting of office work space requires either general area lighting such as overhead fluorescent or indirect lighting units or task lighting in which a light fixture is situated close to the work space and is intended to illuminate only the work space. In some situations, combinations of area lighting and task lighting are utilized. Task lighting units, for example desk lamps, are known to provide close up illumination. The applicant has discovered that the distance of the task lighting unit above the work surface is important to provide adequate lighting. If the fixture is too low, objectionable veiling reflections occur which can interfere with vision at work space. If the fixture is too high, adequate brightness levels at the work surface with reasonable lamp sizes is not achievable. In addition, the high location of fixtures makes it difficult to shield the user's eyes from direct glare.

SUMMARY OF THE INVENTION

The present application teaches a task lighting system which may be integrated into office furniture. A generally rectangular lamp hood closed at the top and sides and open at the bottom is positioned from about 16 to about 26 inches above a work surface such as a desk or work bench. The inner surface of the hood may be from about 15 to about 24 inches deep, from about 4 to about 6 inches thick, and from about 60 to about 96 inches wide. The width of the hood is selected to substantially match the width of the work surface. The work surface can be from about 18 to about 36 inches deep and from about 60 to about 96 inches wide. Two U-shaped fluorescent tubes of a type well known in the art are mounted at an angle diagonally to the side-to-side axis of the hood. The diagonal mounting of the U-shaped fluorescent lamps avoids veiling reflections and the use of diagonal mounting expands the allowable dimensional tolerances on the remainder of the system.

DETAILED DESCRIPTION OF THE PREFERRED EMBODIMENT

Figure 1:
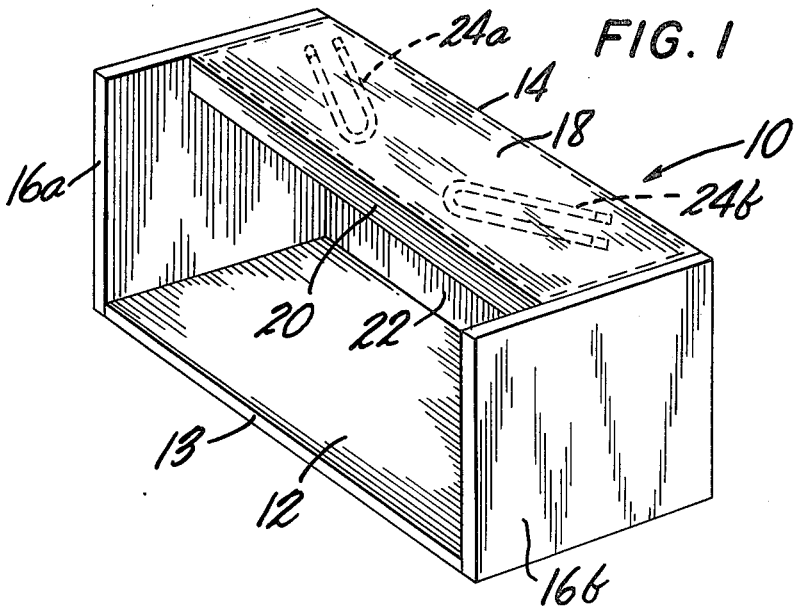
FIG. 1 shows a perspective view of a task lighting system.

Referring to FIG. 1, a task lighting system is shown generally at 10. A work surface 12, which may be a desk, work bench or other work surface has a hood 14 positioned over it. The front edge 13 of the work surface 12 is the preferred location for the worker. The hood 14 may be permanently affixed in position using end plates 16a, 16b or it may be permanently or movably suspended on legs or a cantilever member (not shown). The hood 14 has a generally horizontal flat top 18 and a front lip 20. The lip 20 forms a front edge of the hood which is generally parallel to the front edge 13 of the work surface. The front lip 20 extends downward from about 4 to about 6 inches from the flat top 18. A rear lip (not shown) of similar dimensions may be utilized at the rear of the hood 14. Alternatively, a rear wall 22 may extend downward from the hood 14 to the work surface 12. The rear edge of the hood 14 is in substantial alignment with the rear edge of the work surface 12. A first U-shaped fluorescent lamp **24*a* shown in dashed lines, diagonally positioned in the left half of the hood 14. A second U-shaped fluorescent lamp 24*b*, shown in dashed lines is correspondingly positioned in the right side of the hood 14**.

Figure 2:
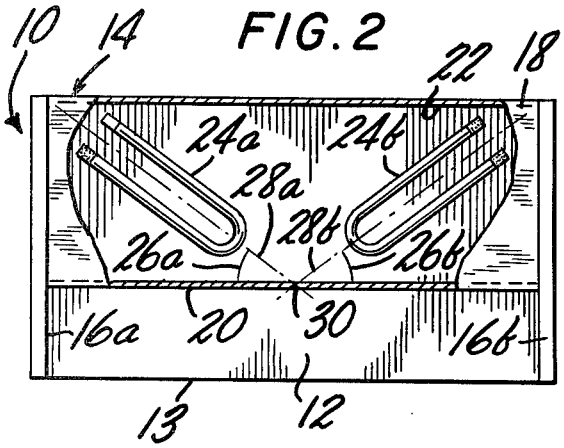
FIGS. 2–5 show arrangements of the lamps in the task lighting system.

Referring now to FIG. 2, the diagonal positioning of the U-shaped lamps is described by the angle **26*a* between a line 28*a* parallel to the axis of the legs of one of the U-shaped lamps and the front edge 30 of the hood 14. The angle 26*a* must be between 9° and 80° to prevent unwanted veiling reflections. The angle 26*b* defined by the line 28*b* parallel to the legs of lamp 24*b* and the front 30 of the hood should be equal to the angle 26*a***.

Figure 3:
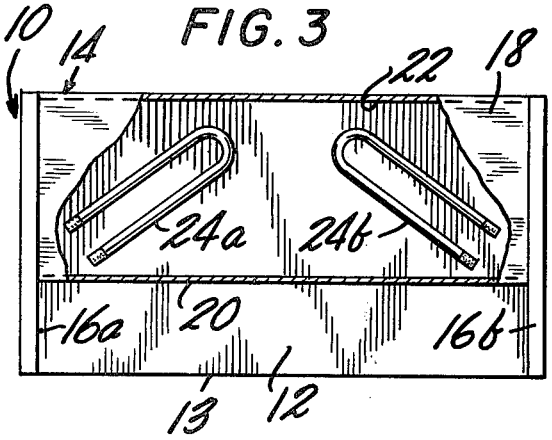
Figure 4:
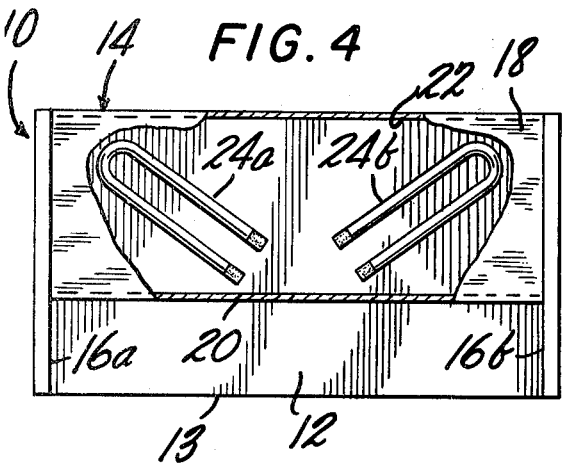
Figure 5:
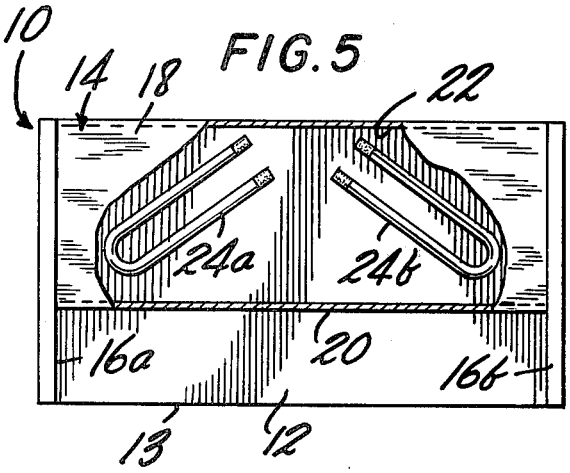

FIGS. 3, 4 and 5 show other permissible orientations of the lamps which satisfy the requirements set forth in the preceding. As shown, the closed end of the U-shaped lamps may be at the front, the rear, the outside, or the inside of the hood 14 without departing from the spirit of the invention.

The embodiments shown in FIGS. 4 and 5 are preferred, however, since placing the crossbar of the U at the lateral outer edges provides additional light in these locations.

Other types of fluorescent lamps besides U-shaped fluorescent lamps may be used in a fashion which conforms to the requirements set forth herein. A pair of straight fluorescent tubes may be substituted for the two legs of each U-shaped lamp. When the pair of tubes are disposed parallel to each other and within the range of angles specified for the legs of the U-shaped fluorescent lamp, substantially similar illumination is achieved.

The U-shaped fluorescent lamps are preferred, however, since their cost is lower than pairs of straight fluorescent tubes. In addition, the U-shaped tubes require only two sockets each rather than the four sockets required for the pair of fluorescent tubes. A U-shaped fluorescent tube, satisfactory for use in the present invention, may be purchased in the United States under the designation F40/C.W./U/6. This designation indicates a fluorescent (F) lamp of 40 watts (40) with cool white color (C.W.) a U shape (U) with the legs of the U spaced 6 inches apart on centers (6). The commercially available lamp has a tube diameter of approximately 1½ inches and a length of 24 inches.

It will be understood that the claims are intended to cover all changes and modifications of the preferred embodiments of the invention, herein chosen for the purpose of illustration which do not constitute departures from the spirit and scope of the invention.

What is claimed is:

1. A task lighting system for illuminating a work surface comprising:

(a) a substantially horizontal hood having a front edge;

(b) said hood having a width of from about 60 to about 90 inches and depth of from about 15 to about 24 inches;

(c) a front lip on the front edge of said hood of from about 4 to about 6 inches;

(d) means for holding said hood from about 16 to about 26 inches above said work surface;

(e) first and second parallel fluorescent tubes in the left half of said hood behind said lip;

(f) the axes of said first and second substantially parallel fluorescent tubes being substantially in a horizontal plane and making an angle of from about 9 to about 80 degrees with respect to said front edge;

(g) third and fourth substantially parallel fluorescent tubes in the right half of said hood behind said lip; and (h) the axes of said third and fourth substantially parallel fluorescent tubes being substantially in a horizontal plane and making the same angle between 9 and 80 degrees with respect to said front edge as the axes of said first and second substantially parallel fluorescent tubes in left-right symmetry about a line normal to the center of said front edge.

2. The lighting system recited in claim 1 further comprising:

(a) said first and second substantially parallel fluorescent tubes being the first and second legs of a first U-shaped fluorescent tube; and (b) said third and fourth substantially parallel fluorescent tubes being the first and second legs of a second U-shaped fluorescent tube.

3. The lighting system recited in claim 2 further comprising the crossbars of the first and second U-shaped fluorescent tubes being disposed nearer the left and right extremities of said hood.

* * * * *